US008013588B2

(12) United States Patent
Imura

(10) Patent No.: US 8,013,588 B2
(45) Date of Patent: Sep. 6, 2011

(54) REFERENCE VOLTAGE CIRCUIT

(75) Inventor: Takashi Imura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 12/641,090

(22) Filed: Dec. 17, 2009

(65) Prior Publication Data

US 2010/0156386 A1 Jun. 24, 2010

(30) Foreign Application Priority Data

Dec. 24, 2008 (JP) ..... 2008-327935

(51) Int. Cl.
*G05F 1/445* (2006.01)
*G05F 1/56* (2006.01)

(52) U.S. Cl. ..... 323/313; 323/316

(58) Field of Classification Search ..... 323/311–315
See application file for complete search history.

(56) References Cited

U.S. PATENT DOCUMENTS 4,327,320 A * 4/1982 Oguey et al. ..... 323/313
5,563,760 A * 10/1996 Lowis et al. ..... 361/103
6,677,808 B1 * 1/2004 Sean et al. ..... 327/539
6,930,538 B2 * 8/2005 Chatal ..... 327/539
2008/0211572 A1 * 9/2008 Riho ..... 327/543

FOREIGN PATENT DOCUMENTS

JP 2000-172353 A 6/2000

OTHER PUBLICATIONS

IEEE Journal of Solid-State Circuits, vol. 36, No. 7 Jul. 2001; Tite: Curvature-Compensated BiCMOS Bandgap with I-V Supply Voltage; Author: Piero Malcovati.*

* cited by examiner

*Primary Examiner* — Gary L Laxton
*Assistant Examiner* — Nusrat J Quddus
(74) *Attorney, Agent, or Firm* — Brinks Hofer Gilson & Lione

(57) ABSTRACT

Provided is a reference voltage circuit capable of generating a temperature-independent reference voltage more stably. Each of N-type metal oxide semiconductor (NMOS) transistors (1) and (2) has a source and a back gate that are short-circuited, and hence threshold voltages (Vth1) and (Vth2) of the NMOS transistors (1) and (2) respectively depend only on process fluctuations in the NMOS transistors (1) and (2) and not on process fluctuations in other elements. As a result, a temperature-independent reference voltage (Vref) may be generated more stably.

14 Claims, 7 Drawing Sheets

REFERENCE VOLTAGE CIRCUIT

RELATED APPLICATIONS

This application claims priority under 35 U.S.C. §119 to Japanese Patent Application No. 2008-327935 filed on Dec. 24, 2008, the entire content of which is hereby incorporated by reference.

BACKGROUND OF THE INVENTION

1. Technical Field

The present invention relates to a reference voltage circuit for generating a reference voltage.

2. Description of the Related Art

Description is given of a conventional reference voltage circuit. FIG. 7 is a circuit diagram illustrating the conventional reference voltage circuit.

In a metal oxide semiconductor (MOS) transistor that operates in weak inversion, when a gate width is represented by W; a gate length, L; a threshold voltage, Vth; a gate-source voltage, Vgs; the electron charge quantity, q; the Boltzmann's constant, k; absolute temperature, T; and constants each determined depending on a process, $Id_0$ and n, a drain current Id is calculated using Expression (61).

$$Id=Id_0\cdot(W/L)\cdot\exp\{(Vgs-Vth)\cdot q/nkT\} \quad (61)$$

When a thermal voltage is expressed by "nkT/q" and is represented by UT, Expression (62) is established.

$$Id=Id_0\cdot(W/L)\cdot\exp\{(Vgs-Vth)/U_T\} \quad (62)$$

Accordingly, the gate-source voltage Vgs is calculated using Expression (63).

$$Vgs=U_T\cdot\ln[Id/\{Id_0\cdot(W/L)\}]+Vth \quad (63)$$

P-type MOS (PMOS) transistors 43 to 45 have a current mirror connection, and hence drain currents Id41, Id42, and Id45 of the PMOS transistors 43, 44, and 45 take the same value.

A voltage generated across a resistor 58 is a voltage (Vgs41−Vgs42) determined by subtracting the gate-source voltage Vgs42 of an N-type MOS (NMOS) transistor 42 that operates in weak inversion from the gate-source voltage Vgs41 of an NMOS transistor 41 that operates in weak inversion. Accordingly, based on the voltage (Vgs41−Vgs42) and a resistance R58 of the resistor 58, the drain current Id42 is calculated, and the drain current Id45 is also calculated. Then, Expression (64) is established.

$$Id45=Id42=(Vgs41-Vgs42)/R58 \quad (64)$$

Accordingly, when a resistance of a resistor 59 is represented by R59, an output voltage Vref generated across the resistor 59 is calculated using Expression (65).

$$Vref=R59\cdot Id45=(R59/R58)\cdot(Vgs41-Vgs42) \quad (65)$$

Through Expression (63), when a gate width of the NMOS transistor 41 is represented by W41; a gate length of the NMOS transistor 41, L41; a threshold voltage of the NMOS transistor 41, Vth41; a gate width of the NMOS transistor 42, W42; a gate length of the NMOS transistor 42, L42; a threshold voltage of the NMOS transistor 42, Vth42; and a difference between the threshold voltages of the NMOS transistors 41 and 42, ΔVth (ΔVth=Vth41−Vth42), the output voltage Vref is calculated using Expression (66).

$$Vref=(R59/R58)\cdot[U_T\cdot\ln\{(W42/L42)/(W41/L41)\}+\Delta Vth] \quad (66)$$

As expressed in Expression (66), each aspect ratio of the NMOS transistors 41 and 42 is adjusted so that a temperature characteristic of the first term and a temperature characteristic of the second term may cancel each other. As a result, the output voltage Vref becomes less likely to be dependent on temperature (see, for example, JP 3024645 B).

However, it is between a source and a back gate of the NMOS transistor 42 and a ground terminal 100 that the resistor 58 exists. Accordingly, process fluctuations in the resistor 58 cause fluctuations in the threshold voltage Vth42 as well. In other words, the threshold voltage Vth42 depends not only on process fluctuations in the NMOS transistor 42 but also on the process fluctuations in the resistor 58. As a result, a reference voltage, which should be independent of temperature, is determined based on the difference between the threshold voltages of the NMOS transistors 41 and 42 (ΔVth=Vth41−Vth42), resulting in a problem of an unstable reference voltage.

SUMMARY OF THE INVENTION

The present invention has been made in view of the above-mentioned problem, and provides a reference voltage circuit capable of generating a temperature-independent reference voltage more stably.

In order to solve the above-mentioned problem, the present invention provides a reference voltage circuit for generating a reference voltage, including: a first power supply terminal; a second power supply terminal; a current supply circuit that has an input terminal to which a current is input, and a first output terminal and a second output terminal from each of which a current determined based on the current flowing through the input terminal is output; a first resistor; a first metal oxide semiconductor (MOS) transistor of a first conductivity type, the first MOS transistor having a gate connected to the first output terminal, a source and a back gate that are connected to the first power supply terminal, and a drain connected to the first output terminal via the first resistor, the first MOS transistor operating in weak inversion; a second MOS transistor of the first conductivity type, the second MOS transistor having a gate connected to a connection point between the first resistor and the first MOS transistor, a source and a back gate that are connected to the first power supply terminal, and a drain connected to the input terminal, the second MOS transistor having an absolute value of a threshold voltage of the second MOS transistor smaller than an absolute value of a threshold voltage of the first MOS transistor, the second MOS transistor operating in weak inversion; and a second resistor across which the reference voltage is generated, the second resistor being provided between the second output terminal and the first power supply terminal.

Further, in order to solve the above-mentioned problem, the present invention provides a reference voltage circuit for generating a reference voltage, including: a first power supply terminal; a second power supply terminal; a current supply circuit that has an input terminal to which a current is input, and an output terminal from which a current determined based on the current flowing through the input terminal is output; a first resistor; a first MOS transistor of a second conductivity type, the first MOS transistor having a gate connected to the output terminal, a source and a back gate that are connected to the second power supply terminal, and a drain connected to the output terminal via the first resistor, the first MOS transistor operating in weak inversion; a second MOS transistor of the second conductivity type, the second MOS transistor having a gate connected to a connection point between the first resistor and the first MOS transistor, a source and a back gate that are connected to the second power supply terminal, and a drain connected to the input terminal, the second MOS transistor having an absolute value of a threshold voltage of the second MOS transistor smaller than an absolute value of a threshold voltage of the first MOS transistor, the second MOS transistor operating in weak inversion; a third MOS transistor of the second conductivity type, the third MOS transistor having a gate connected to the output terminal, and a source and a back gate that are connected to the second power supply terminal; and a second resistor across which the reference voltage is generated, the second resistor being provided between a drain of the third MOS transistor and the first power supply terminal.

According to the present invention, each of the first and second MOS transistors has the source and the back gate that are short-circuited, and hence the threshold voltages of the first and second MOS transistors respectively depend only on process fluctuations in the first and second MOS transistors and not on process fluctuations in other elements. As a result, a temperature-independent reference voltage may be generated more stably.

DETAILED DESCRIPTION OF THE PREFERRED EMBODIMENTS

Referring to the accompanying drawings, embodiments of the present invention are described below.

First Embodiment

Figure 1:
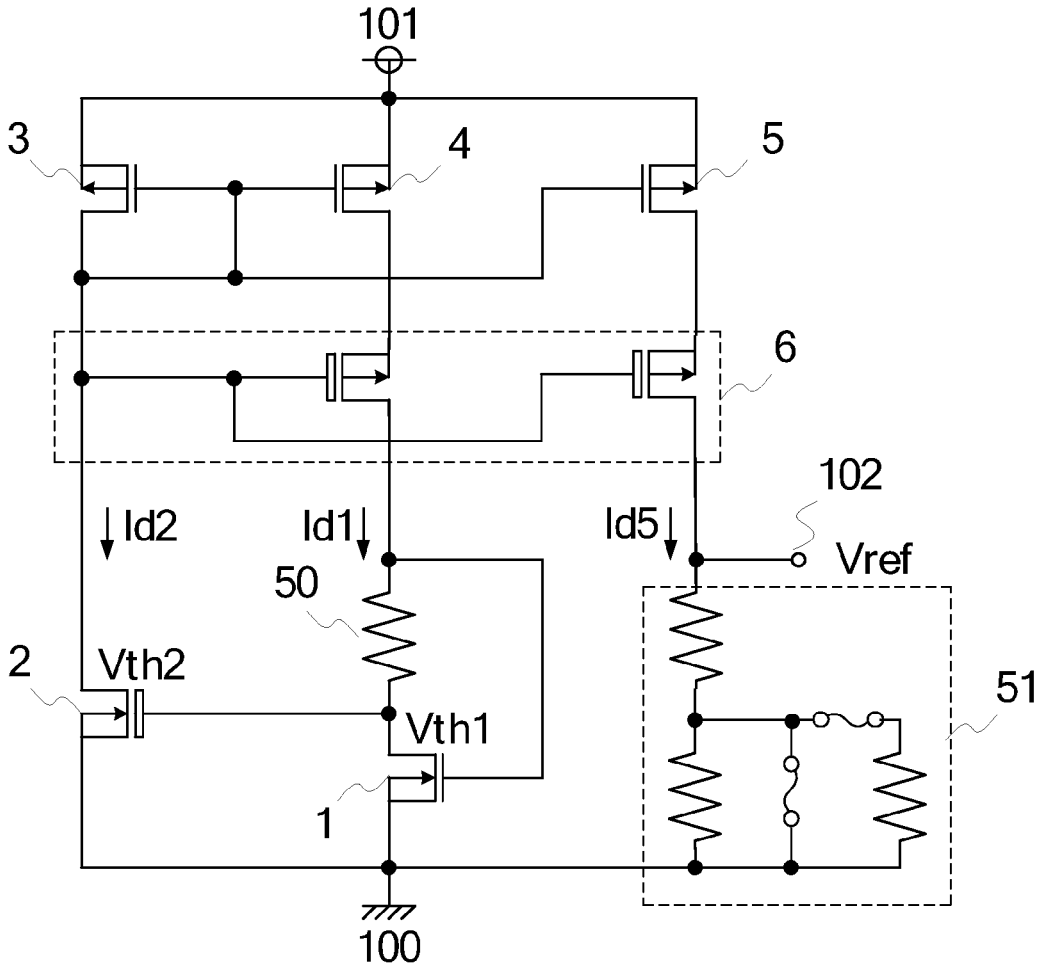
FIG. 1 illustrates a circuit diagram of a reference voltage circuit according to a first embodiment of the present invention.

First, a configuration of a reference voltage circuit according to a first embodiment of the present invention is described. FIG. 1 illustrates the reference voltage circuit according to the first embodiment.

The reference voltage circuit includes P-type metal oxide semiconductor (PMOS) transistors 3 to 5, N-type metal oxide semiconductor (NMOS) transistors 1 and 2, and resistors 50 and 51. The reference voltage circuit further includes a power supply terminal 101, a ground terminal 100, and an output terminal 102.

The PMOS transistor 3 has a gate and a drain that are connected to a drain of the NMOS transistor 2, and has a source and a back gate that are connected to the power supply terminal 101. The PMOS transistor 4 has a gate connected to the gate of the PMOS transistor 3, a source and a back gate that are connected to the power supply terminal 101, and a drain connected to one terminal of the resistor 50 and a gate of the NMOS transistor 1. The PMOS transistor 5 has a gate connected to the gate of the PMOS transistor 3, a source and a back gate that are connected to the power supply terminal 101, and a drain connected to the output terminal 102. The NMOS transistor 2 has a gate connected to another terminal of the resistor 50 and a drain of the NMOS transistor 1, and has a source and a back gate that are connected to the ground terminal 100. The NMOS transistor 1 has a source and a back gate that are connected to the ground terminal 100. The resistor 51 is provided between the output terminal 102 and the ground terminal 100.

The PMOS transistors 3 to 5 have the same aspect ratio. In addition, the gates of the PMOS transistors 3 to 5 are connected to one another. Accordingly, respective drain currents flowing through the PMOS transistors 3 to 5 also take the same value. The PMOS transistors 3 to 5 function as a current supply circuit, and the current supply circuit has an input terminal (drain of the PMOS transistor 3) to which a current is input, and an output terminal (drain of the PMOS transistor 4) and an output terminal (drain of the PMOS transistor 5) from each of which a current determined based on the current flowing through the input terminal is output.

Further, each of the NMOS transistors 1 and 2 is designed to have a gate width large enough with respect to the corresponding drain current, and hence the NMOS transistors 1 and 2 operate in weak inversion.

Still further, the NMOS transistor 1 has an absolute value of its threshold voltage larger than an absolute value of a threshold voltage of the NMOS transistor 2.

The resistors 50 and 51 are formed of the same kind of polycrystalline silicon. Ion implantation dose of the resistors 50 and 51 is set so that the resistors 50 and 51 may have a minimum temperature coefficient.

The NMOS transistors 1 and 2 are formed on substrates having the same concentration, and only one of the NMOS transistor 1 and the NMOS transistor 2 is subjected to channel doping. Accordingly, process fluctuations in difference between the threshold voltages of the NMOS transistors 1 and 2 depend only on fluctuations in the channel doping process of the one of the NMOS transistor 1 and the NMOS transistor 2. As a result, compared to the case of using depletion-type NMOS transistors, the influence of the process fluctuations may be reduced.

Alternatively, the NMOS transistors 1 and 2 are formed on substrates having the same concentration, and the NMOS transistor 1 and the NMOS transistor 2 may be subjected to channel doping once and thereafter, only one of the NMOS transistor 1 and the NMOS transistor 2 may be subjected to channel doping once more.

Next, an operation of the reference voltage circuit according to the first embodiment is described.

In a MOS transistor that operates in weak inversion, when a gate width is represented by W; a gate length, L; a threshold voltage, Vth; a gate-source voltage, Vgs; the electron charge quantity, q; the Boltzmann's constant, k; absolute temperature, T; and constants each determined depending on a process, $Id_0$ and n, a drain current Id is calculated using Expression (11).

$$Id=Id_0\cdot(W/L)\cdot\exp\{(Vgs-Vth)\cdot q/nkT\} \quad (11)$$

When a thermal voltage is expressed by "nkT/q" and is represented by UT, Expression (12) is established.

$$Id=Id_0\cdot(W/L)\cdot\exp\{(Vgs-Vth)/U_T\} \quad (12)$$

Accordingly, the gate-source voltage Vgs is calculated using Expression (13).

$$Vgs=U_T\cdot\ln[Id/\{Id_0\cdot(W/L)\}]+Vth \quad (13)$$

When a gate-source voltage of the NMOS transistor 1 is represented by Vgs1; a gate-source voltage of the NMOS transistor 2, Vgs2; and a resistance of the resistor 50, R50, a drain current Id1 of the NMOS transistor 1 is calculated using Expression (14).

$$Id1=(Vgs1-Vgs2)/R50 \quad (14)$$

Further, through Expression (13), when a drain current of the NMOS transistor 2 is represented by Id2; a gate width of the NMOS transistor 1, W1; a gate length of the NMOS transistor 1, L1; the threshold voltage of the NMOS transistor 1, Vth1; a gate width of the NMOS transistor 2, W2; a gate length of the NMOS transistor 2, L2; and the threshold voltage of the NMOS transistor 2, Vth2, the gate-source voltages Vgs1 and Vgs2 are respectively calculated using Expressions (15) and (16).

$$Vgs1=U_T\cdot\ln[Id1/\{Id_0\cdot(W1/L1)\}]+Vth1 \quad (15)$$

$$Vgs2=U_T\cdot\ln[Id2/\{Id_0\cdot(W2/L2)\}]+Vth2 \quad (16)$$

Through Expressions (14) to (16), when the drain currents Id1 and Id2 take the same value, and a difference between the threshold voltages of the NMOS transistors 1 and 2 is represented by ΔVth (ΔVth=Vth1−Vth2), the drain current Id1 is calculated using Expression (17) and Expression (18).

$$Id1=(1/R50)\cdot[U_T\cdot\ln\{(Id1/Id2)\cdot(W2/L2)/(W1/L1)\}+\Delta Vth] \quad (17)$$

$$Id1=(1/R50)\cdot[U_T\cdot\ln\{(W2/L2)/(W1/L1)\}+\Delta Vth] \quad (18)$$

Figure 2:
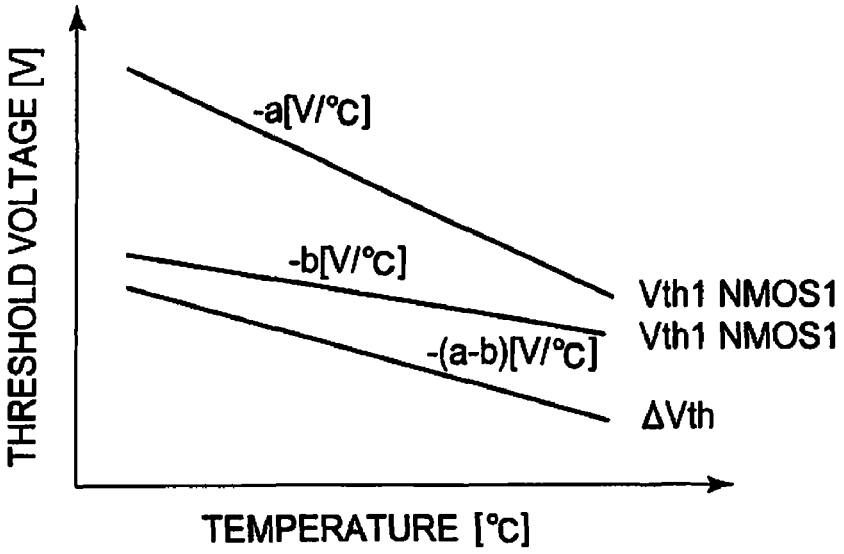
FIG. 2 is a graph illustrating temperature characteristics of absolute values of threshold voltages of N-type metal oxide semiconductor (NMOS) transistors.

In Expression (18), the thermal voltage UT has a positive temperature coefficient because the thermal voltage UT is directly proportional to temperature. In addition, as illustrated in FIG. 2, each of the threshold voltages Vth1 and Vth2 of the NMOS transistors 1 and 2 has a negative temperature coefficient. The NMOS transistor 1, which is set to have a larger absolute value of its threshold voltage, has a steeper inclination of its temperature coefficient than an inclination of the temperature coefficient of the NMOS transistor 2. Accordingly, the threshold voltage difference (ΔVth=Vth1−Vth2) also has a negative temperature coefficient. Thus, in Expression (18), the first term has a positive temperature coefficient while the second term has a negative temperature coefficient, and hence each aspect ratio of the NMOS transistors 1 and 2 is adjusted so that the temperature characteristic of the first term and the temperature characteristic of the second term may cancel each other. As a result, the drain current Id1 becomes less likely to be dependent on temperature.

Then, because the gates of the PMOS transistors 4 and 5 are connected to each other and the sources thereof are connected to the power supply terminal 101, the drain current Id1 and a drain current Id5 take the same value. Accordingly, Expression (19) is established.

$$Id5=Id1 \quad (19)$$

When a resistance of the resistor 51 is represented by R51, an output voltage Vref generated between the output terminal 102 and the ground terminal 100 (generated across the resistor 51) is calculated using Expression (20).

$$Vref=R51\cdot d5=(R51/R50)\cdot[U_T\cdot\ln\{(W2/L2)/(W1/L1)\}+\Delta Vth] \quad (20)$$

In Expression (20), in the same manner as described above, each aspect ratio of the NMOS transistors 1 and 2 is adjusted so that the temperature characteristic of the first term and the temperature characteristic of the second term may cancel each other. As a result, the output voltage Vref becomes less likely to be dependent on temperature. Further, each of the resistors 50 and 51, which are formed of the same kind of polycrystalline silicon, has the temperature characteristic, but those temperature characteristics cancel each other as expressed in "(R51/R50)" in Expression (20).

Each of the NMOS transistors 1 and 2 has the source and the back gate that are short-circuited, and hence the threshold voltages Vth1 and Vth2 respectively depend only on the process fluctuations in the NMOS transistors 1 and 2 and not on process fluctuations in other elements. As a result, the reference voltage Vref that is independent of temperature is generated more stably.

Note that, instead of using the resistors 50 and 51, MOS transistors that operate in a linear region may be used.

Further, such a configuration may be employed that each of the resistors 50 and 51 is formed of a plurality of resistors (as shown resistor 51 of FIG. 1) and each connection relation between the resistors is changed in a wiring process so that the resistors 50 and 51 may have a variable resistance. With this configuration, the output voltage Vref may be adjusted to an arbitrary voltage value.

Further alternatively, such a configuration may be employed that each of the resistors 50 and 51 is formed of a plurality of resistors and fuses (as shown in resistor 51 of FIG. 1) and each connection relation between the resistors is changed by disconnecting the corresponding fuse so that the resistors 50 and 51 may have a variable resistance. With this configuration, the output voltage Vref may be adjusted to an arbitrary voltage value.

Still further, the PMOS transistors 3 to 5 may have different aspect ratios.

Figure 3:
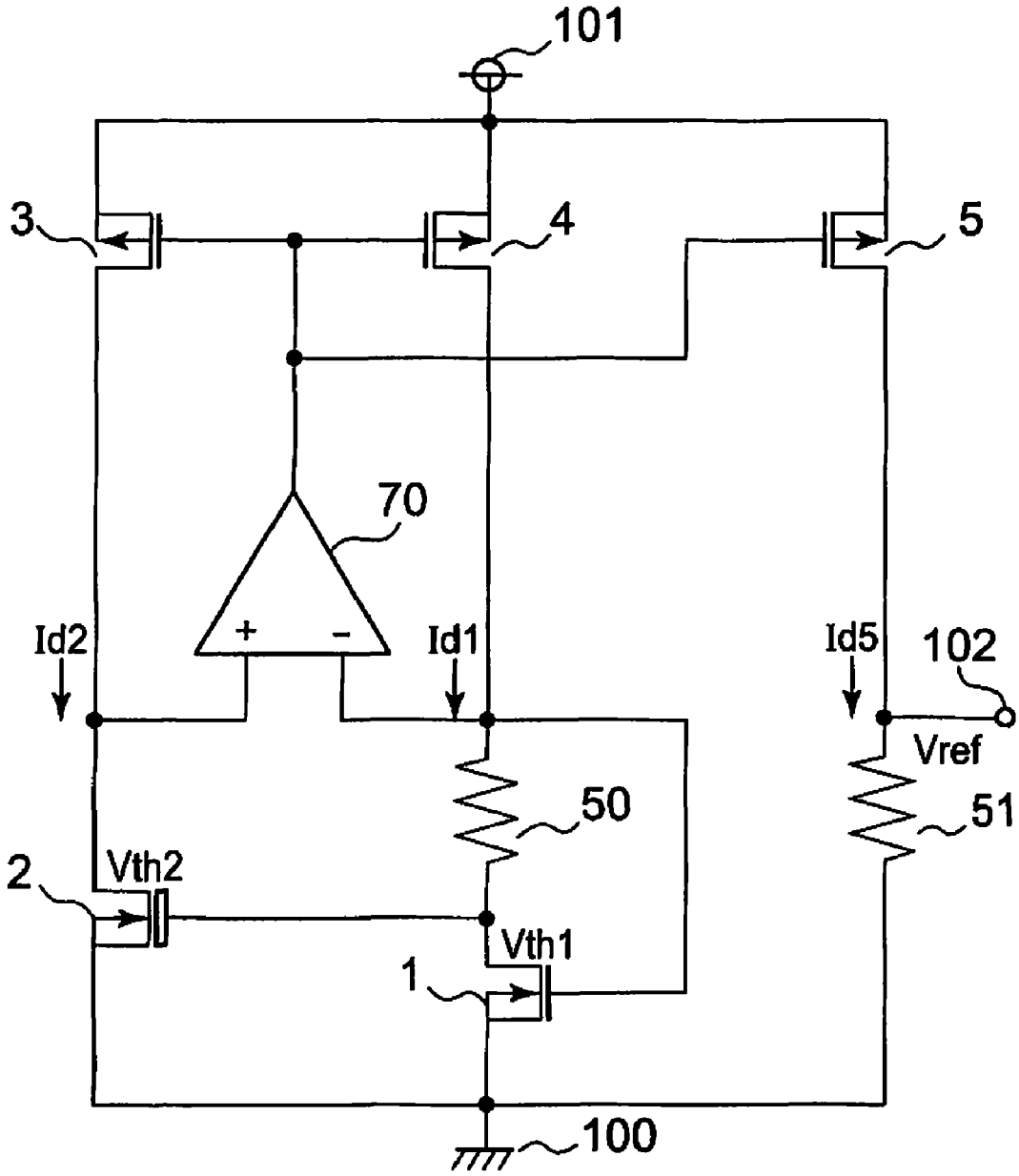
FIG. 3 is a circuit diagram illustrating another example of the reference voltage circuit according to the first embodiment of the present invention.

Still further, though the drain of the PMOS transistor 3 is connected to the gates of the PMOS transistors 3 to 5 in FIG. 1, such a configuration as illustrated in FIG. 3 may be employed. That is, an amplifier 70 is provided whose non-inverting input terminal is connected to a connection point between the drain of the PMOS transistor 3 and the drain of the NMOS transistor 2, whose inverting input terminal is connected to a connection point between the drain of the PMOS transistor 4 and the one terminal of the resistor 50, and whose output terminal is connected to the gates of the PMOS transistors 3 to 5. With this configuration, drain voltages of the PMOS transistors 3 and 4 take the same value more accurately, and hence the drain currents Id1 and Id2 take the same value more accurately. Accordingly, through Expression (17), the drain current Id1 may be calculated more accurately.

Figure 4:
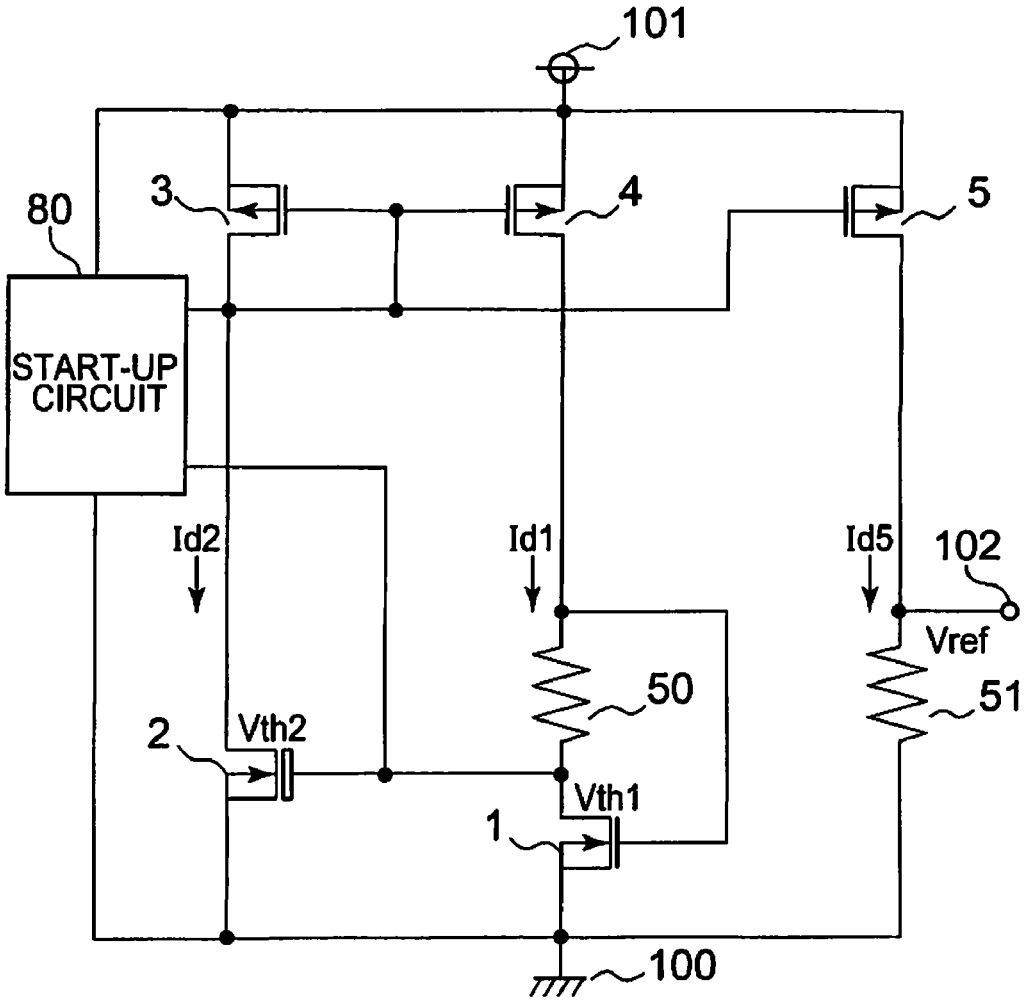
FIG. 4 is a circuit diagram illustrating a further example of the reference voltage circuit according to the first embodiment of the present invention.

Further alternatively, as illustrated in FIG. 4, a start-up circuit 80 may be provided. In a case where the reference voltage circuit has two stable points, that is, the ones occurring in the state of being supplied with absolutely no current and the state of being supplied with a current, the start-up circuit 80 operates so that the reference voltage circuit may shift from the former state to the latter state. Specifically, when the drain current flowing through the PMOS transistor 3 and the NMOS transistor 2 is lower than a predetermined current value, and when a gate voltage of the PMOS transistor 3 is a predetermined voltage value or higher, the start-up circuit 80 allows a start-up current to flow from the power supply terminal 101 to the gate of the NMOS transistor 2, to thereby start up the reference voltage circuit.

Figure 5:
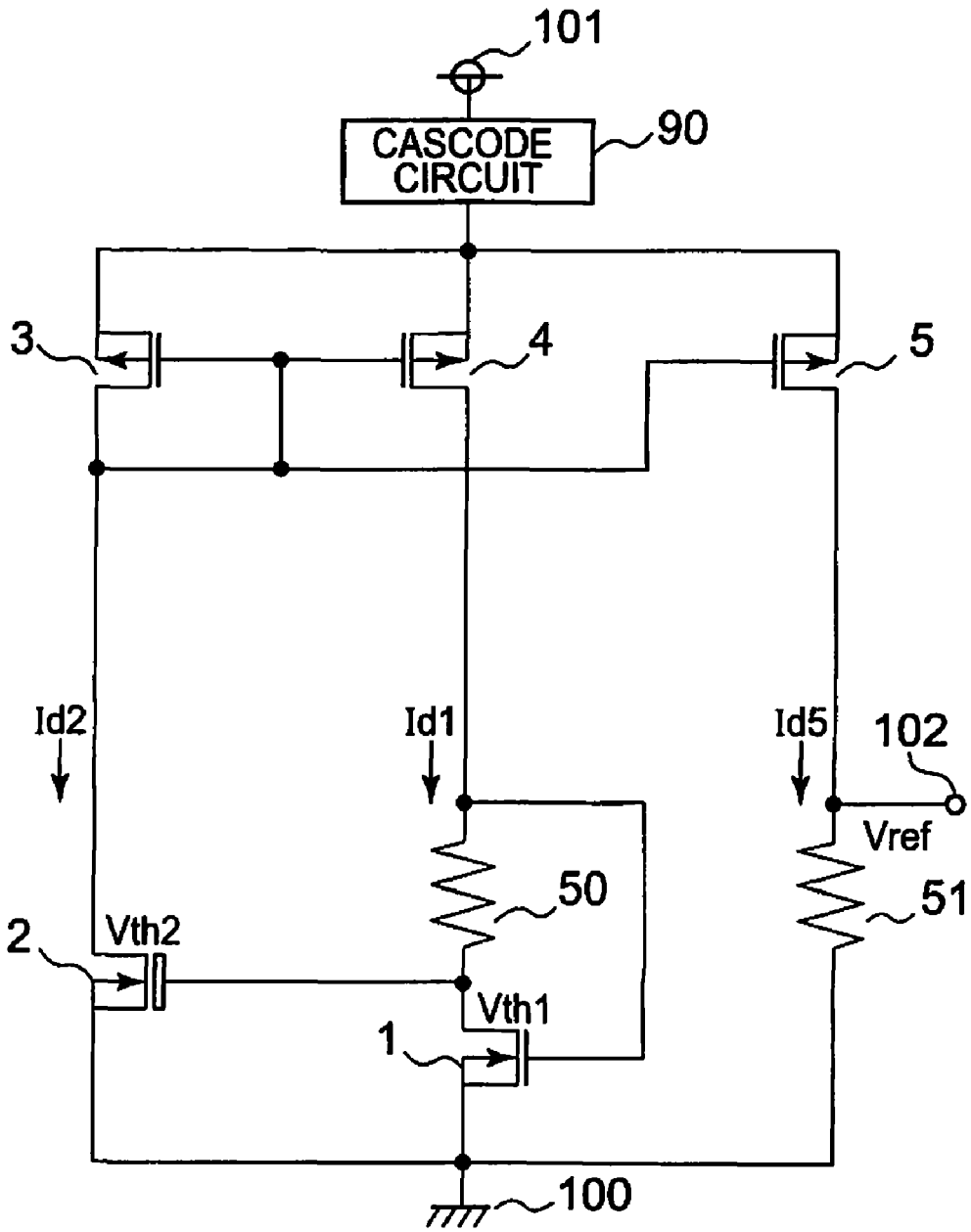
FIG. 5 is a circuit diagram illustrating a still further example of the reference voltage circuit according to the first embodiment of the present invention.

Still further alternatively, as illustrated in FIG. 5, a cascode circuit 90 may be provided between the power supply terminal 101 and the sources of the PMOS transistors 3 to 5. In this case, it is via the cascode circuit 90 that a power supply voltage is supplied from the power supply terminal 101 to the sources of the PMOS transistors 3 to 5. Accordingly, even when the power supply voltage fluctuates, source voltages of the PMOS transistors 3 to 5 may be less likely to fluctuate, resulting in an improved power supply rejection ratio.

Further, as illustrated in FIG. 1, a cascode circuit 6 may be provided between each drain of the PMOS transistors 3 to 5 and its connection destination. In this case, even when the power supply voltage fluctuates, voltages of the connection destinations may be less likely to fluctuate, resulting in an improved power supply rejection ratio.

Further, in FIG. 1, the NMOS transistors operate in weak inversion and the PMOS transistors form a current mirror circuit so that the output voltage Vref may be generated between the output terminal 102 and the ground terminal 100. However, though not illustrated, such a configuration may be employed that PMOS transistors operate in weak inversion and NMOS transistors form the current mirror circuit so that the output voltage Vref may be generated between the power supply terminal 101 and the output terminal 102.

Second Embodiment

Figure 6:
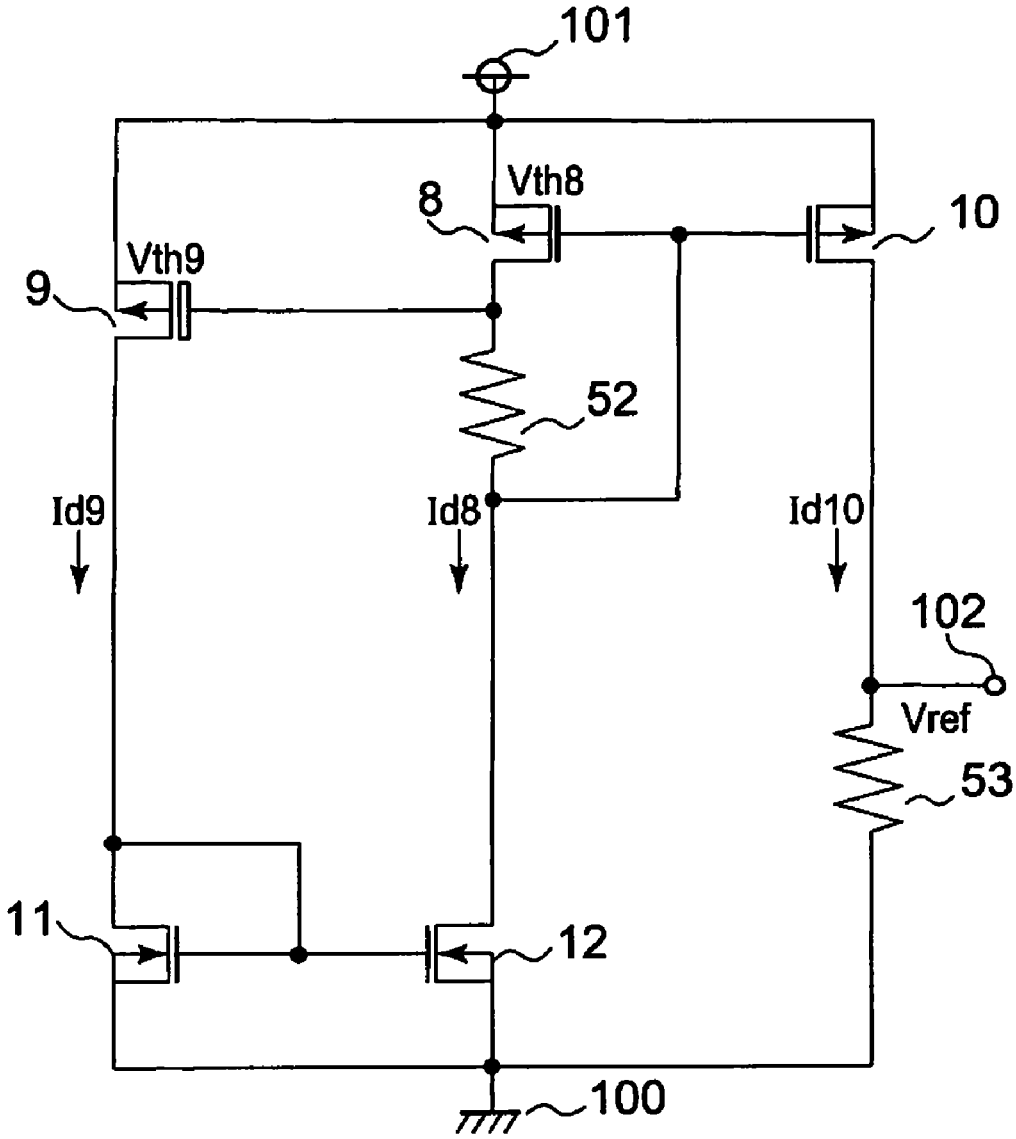
FIG. 6 illustrates a circuit diagram of a reference voltage circuit according to a second embodiment of the present invention.
Figure 7:
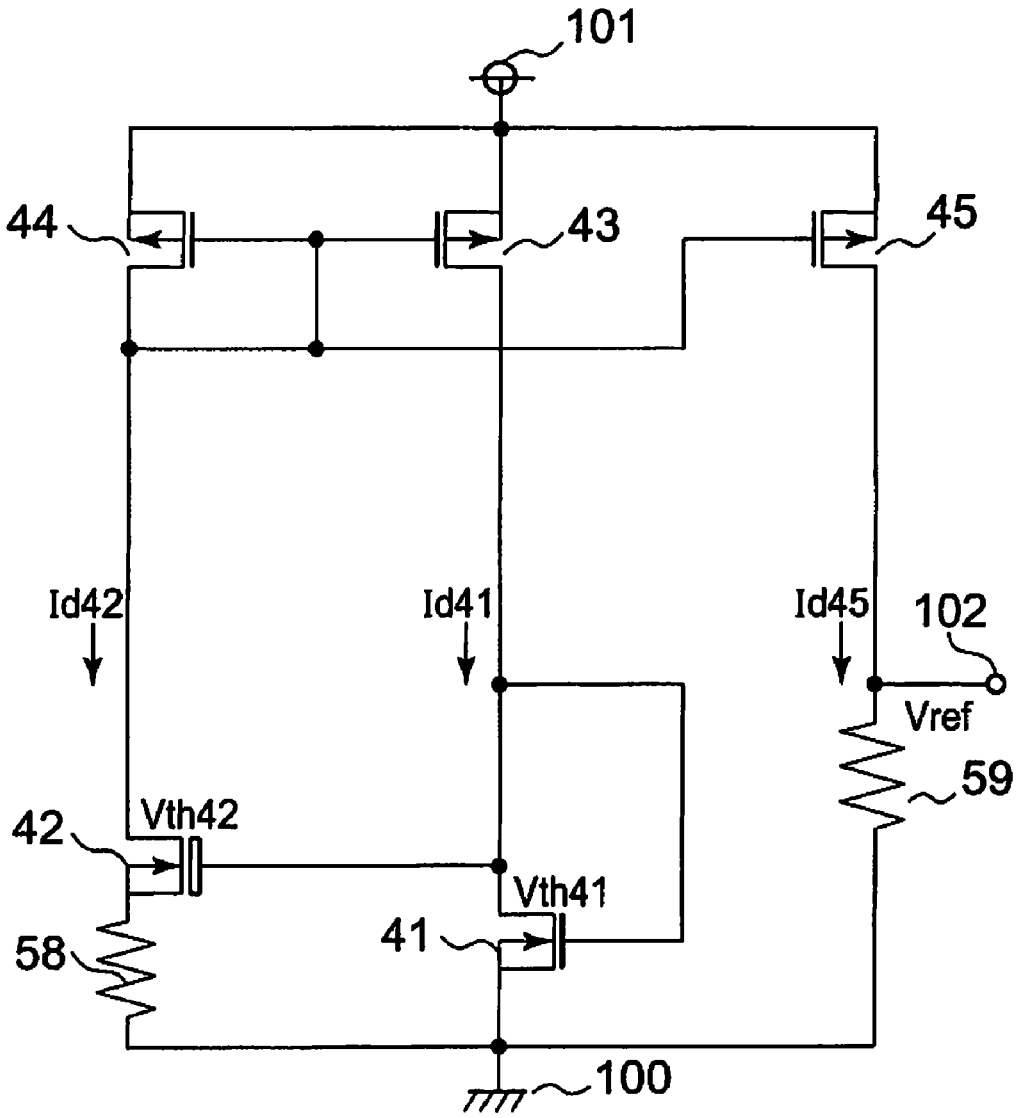
PRIOR ART FIG. 7
FIG. 7 illustrates a circuit diagram of a conventional reference voltage circuit.

First, a configuration of a reference voltage circuit according to a second embodiment of the present invention is described. FIG. 6 illustrates the reference voltage circuit according to the second embodiment.

The reference voltage circuit includes P-type metal oxide semiconductor (PMOS) transistors 8 to 10, N-type metal oxide semiconductor (NMOS) transistors 11 and 12, and resistors 52 and 53. The reference voltage circuit further includes the power supply terminal 101, the ground terminal 100, and the output terminal 102.

The NMOS transistor 11 has a gate and a drain that are connected to a drain of the PMOS transistor 9, and has a source and a back gate that are connected to the ground terminal 100. The NMOS transistor 12 has a gate connected to the gate of the NMOS transistor 11, a source and a back gate that are connected to the ground terminal 100, and a drain connected to one terminal of the resistor 52. The PMOS transistor 9 has a gate connected to a connection point between a drain of the PMOS transistor 8 and another terminal of the resistor 52, and has a source and a back gate that are connected to the power supply terminal 101. The PMOS transistor 8 has a gate connected to a gate of the PMOS transistor 10 and the one terminal of the resistor 52, and has a source and a back gate that are connected to the power supply terminal 101. The PMOS transistor 10 has a source and a back gate that are connected to the power supply terminal 101, and has a drain connected to the output terminal 102. The resistor 53 is provided between the output terminal 102 and the ground terminal 100.

The NMOS transistors 11 and 12 have the same aspect ratio. In addition, the gates of the NMOS transistors 11 and 12 are connected to each other. Accordingly, respective drain currents flowing through the NMOS transistors 11 and 12 also take the same value. The NMOS transistors 11 and 12 function as a current supply circuit, and the current supply circuit has an input terminal (drain of the NMOS transistor 11) to which a current is input, and an output terminal (drain of the NMOS transistor 12) from which a current determined based on the current flowing through the input terminal is output.

Next, an operation of the reference voltage circuit according to the second embodiment is described.

When a gate-source voltage of the PMOS transistor 8 is represented by Vgs8; a gate-source voltage of the PMOS transistor 9, Vgs9; and a resistance of the resistor 52, R52, a drain current Id8 of the PMOS transistor 8 is calculated using Expression (34).

$$Id8=(Vgs8-Vgs9)/R52 \tag{34}$$

Further, through Expression (13), when a drain current of the PMOS transistor 9 is represented by Id9; a gate width of the PMOS transistor 8, W8; a gate length of the PMOS transistor 8, L8; the threshold voltage of the PMOS transistor 8, Vth8; a gate width of the PMOS transistor 9, W9; a gate length of the PMOS transistor 9, L9; and the threshold voltage of the PMOS transistor 9, Vth9, the gate-source voltages Vgs8 and Vgs9 are respectively calculated using Expressions (35) and (36).

$$Vgs8=U_T\cdot\ln\,[Id8/\{Id_0\cdot(W8/L8)\}]+Vth8 \tag{35}$$

$$Vgs9=U_T\cdot\ln\,[Id9/\{Id_0\cdot(W9/L9)\}]+Vth9 \tag{36}$$

Through Expressions (34) to (36), when the drain currents Id8 and Id9 take the same value, and a difference between the threshold voltages of the PMOS transistors 8 and 9 is represented by ΔVth (ΔVth=Vth8-Vth9), the drain current Id8 is calculated using Expression (37) and Expression (38).

$$Id8=(1/R52)\cdot[U_T\cdot\ln\,\{(Id8/Id9)\cdot(W9/L9)/(W8/L8)\}+\Delta Vth] \tag{37}$$

$$Id8=(1/R52)\cdot[U_T\cdot\ln\,\{(W9/L9)/(W8/L8)\}+\Delta Vth] \tag{38}$$

As expressed in Expression (38), similarly to the first embodiment, the drain current Id8 becomes less likely to be dependent on temperature.

Then, because the gates of the PMOS transistors 8 and 10 are connected to each other and the sources thereof are connected to the power supply terminal 101, the drain current Id8 and a drain current Id10 take the same value. Accordingly, Expression (39) is established.

$$\mathrm{Id10}=\mathrm{Id8} \tag{39}$$

When a resistance of the resistor 53 is represented by R53, an output voltage Vref generated between the output terminal 102 and the ground terminal 100 is calculated using Expression (40).

$$Vref=R53\cdot Id10=(R53/R52)\cdot[U_T\cdot\ln\,\{(W9/L9)/(W8/L8)\}+\Delta Vth] \tag{40}$$

As a result, similarly to the first embodiment, temperature characteristics of the resistors 52 and 53 may cancel each other.

What is claimed is:

1. A reference voltage circuit for generating a reference voltage, comprising:

a first power supply terminal;

a second power supply terminal;

a current supply circuit that has an input terminal to which a current is input, and a first output terminal and a second output terminal from each of which a current determined based on the current flowing through the input terminal is output;

a first resistor;

a first non-depletion mode metal oxide semiconductor (MOS) transistor of a first conductivity type, the first MOS transistor having a gate connected to the first output terminal, a source and a back gate that are connected to the first power supply terminal, and a drain connected to the first output terminal via the first resistor, the first MOS transistor operating in weak inversion;

a second non-depletion mode MOS transistor of the first conductivity type, the second MOS transistor having a gate connected to a connection point between the first resistor and the first MOS transistor, a source and a back gate that are connected to the first power supply terminal, and a drain connected to the input terminal, the second MOS transistor having an absolute value of a threshold voltage of the second MOS transistor smaller than an absolute value of a threshold voltage of the first MOS transistor, the second MOS transistor operating in weak inversion, wherein a value of the threshold voltage is independent of structural variations in the first resistor and wherein a difference in the threshold voltage of the first and second MOS transistors is independent of structural variations in the first resistor; and a second resistor across which the reference voltage is generated, the second resistor being provided between the second output terminal and the first power supply terminal.

2. A reference voltage circuit according to claim 1, wherein the current supply circuit comprises:

a third MOS transistor of a second conductivity type, the third MOS transistor having a gate and a drain that are connected to the input terminal, and a source and a back gate that are connected to the second power supply terminal;

a fourth MOS transistor of the second conductivity type, the fourth MOS transistor having a gate connected to the input terminal, a source and a back gate that are connected to the second power supply terminal, and a drain connected to the first output terminal; and a fifth MOS transistor of the second conductivity type, the fifth MOS transistor having a gate connected to the input terminal, a source and a back gate that are connected to the second power supply terminal, and a drain connected to the second output terminal.

3. A reference voltage circuit according to claim 2, wherein the current supply circuit further comprises a plurality of cascode circuits that are respectively provided between the drain of the third MOS transistor and the input terminal, between the drain of the fourth MOS transistor and the first output terminal, and between the drain of the fifth MOS transistor the second output terminal.

4. A reference voltage circuit according to claim 1, wherein the current supply circuit comprises:

an amplifier that has an output terminal, a non-inverting input terminal connected to the input terminal of the current supply circuit, and an inverting input terminal connected to the first output terminal of the current supply circuit;

a third MOS transistor of a second conductivity type, the third MOS transistor having a gate connected to the output terminal of the amplifier, a source and a back gate that are connected to the second power supply terminal, and a drain connected to the input terminal;

a fourth MOS transistor of the second conductivity type, the fourth MOS transistor having a gate connected to the output terminal of the amplifier, a source and a back gate that are connected to the second power supply terminal, and a drain connected to the first output terminal; and a fifth MOS transistor of the second conductivity type, the fifth MOS transistor having a gate connected to the output terminal of the amplifier, a source and a back gate that are connected to the second power supply terminal, and a drain connected to the second output terminal.

5. A reference voltage circuit according to claim 1, wherein the first MOS transistor and the second MOS transistor are formed on substrates having the same concentration, and wherein only one of the first MOS transistor and the second MOS transistor is formed by being subjected to channel doping.

6. A reference voltage circuit according to claim 1, wherein the first MOS transistor and the second MOS transistor are formed on substrates having the same concentration, and wherein the first MOS transistor and the second MOS transistor are formed by being subjected to channel doping once, and only one of the first MOS transistor and the second MOS transistor is formed by being subsequently subjected to channel doping once more.

7. A reference voltage circuit according to claim 1, wherein the first resistor and the second resistor are formed of the same kind of material.

8. A reference voltage circuit according to claim 7, wherein the material comprises polycrystalline silicon.

9. A reference voltage circuit according to claim 1, wherein each of the first resistor and the second resistor comprises a MOS transistor that operates in a linear region.

10. A reference voltage circuit according to claim 1, wherein each of the first resistor and the second resistor comprises a plurality of connected resistors, and wherein each connection between the plurality of resistors is arranged such that the each of the first and second resistors has a variable resistance.

11. A reference voltage circuit according to claim 1, wherein each of the first resistor and the second resistor comprises a plurality of interconnected resistors and fuses, and wherein selected connections between the plurality of resistors includes a disconnected fuse such that the each of the first and second resistors has a variable resistance.

12. A reference voltage circuit according to claim 1, further comprising a start-up circuit for allowing, when a drain current of the second MOS transistor is lower than a predetermined current value, a start-up current to flow into the gate of the second MOS transistor.

13. A reference voltage circuit according to claim 1, further comprising a cascode circuit between one of the first power supply terminal and the second power supply terminal, and a circuit comprising the current supply circuit, the first resistor, the first MOS transistor, the second MOS transistor, and the second resistor.

14. A reference voltage circuit for generating a reference voltage, comprising:

a first power supply terminal;

a second power supply terminal;

a current supply circuit that has an input terminal to which a current is input, and an output terminal from which a current determined based on the current flowing through the input terminal is output;

a first resistor;

a first non-depletion mode MOS transistor of a second conductivity type, the first MOS transistor having a gate connected to the output terminal, a source and a back gate that are connected to the second power supply terminal, and a drain connected to the output terminal via the first resistor, the first MOS transistor operating in weak inversion;

a second non-depletion mode MOS transistor of the second conductivity type, the second MOS transistor having a gate connected to a connection point between the first resistor and the first MOS transistor, a source and a back gate that are connected to the second power supply terminal, and a drain connected to the input terminal, the second MOS transistor having an absolute value of a threshold voltage of the second MOS transistor smaller than an absolute value of a threshold voltage of the first MOS transistor, the second MOS transistor operating in weak inversion, wherein a value of the threshold voltage is independent of structural variations in the first resistor and wherein a difference in the threshold voltage of the first and second MOS transistors is independent of structural variations in the first resistor;

a third MOS transistor of the second conductivity type, the third MOS transistor having a gate connected to the output terminal, and a source and a back gate that are connected to the second power supply terminal; and a second resistor across which the reference voltage is generated, the second resistor being provided between a drain of the third MOS transistor and the first power supply terminal.

* * * * *

UNITED STATES PATENT AND TRADEMARK OFFICE

CERTIFICATE OF CORRECTION

PATENT NO. : 8,013,588 B2
APPLICATION NO. : 12/641090
DATED : September 6, 2011
INVENTOR(S) : Imura It is certified that error appears in the above-identified patent and that said Letters Patent is hereby corrected as shown below:

In the Claims

In column 10, claim 10, line 32, after "arranged such that" replace "the each of" with --each of--.

In column 10, claim 11, line 39, after "disconnected fuse such that" replace "the each" with --each--.

Signed and Sealed this
Third Day of April, 2012

David J. Kappos

David J. Kappos
*Director of the United States Patent and Trademark Office*